United States Patent [19]

Motley

[11] 4,345,406

[45] Aug. 24, 1982

[54] BLEACHER STRUCTURE

[75] Inventor: Larry L. Motley, Marianna, Fla.

[73] Assignee: Jewell C. Griffin, Jr., Cottondale, Fla. ; a part interest

[21] Appl. No.: 103,392

[22] Filed: Dec. 13, 1979

[51] Int. Cl.[3] ..... E04H 3/12

[52] U.S. Cl. ..... 52/8; 108/159; 248/177

[58] Field of Search ..... 52/6, 8, 9, 10, 669; 256/59, 65; 108/159; 248/177, 158, 219.2

[56] References Cited

U.S. PATENT DOCUMENTS

| | | | |
|---|---|---|---|
| 3,154,180 | 10/1964 | McCubbin | 256/65 |
| 3,420,015 | 1/1969 | Costanzo | 52/669 |
| 3,482,819 | 12/1969 | Leurent | 256/59 |
| 3,484,827 | 12/1969 | Hall | 256/65 |
| 3,506,243 | 4/1970 | Seiler | 256/59 |
| 3,973,756 | 8/1976 | Lauzier | 256/65 |
| 4,011,695 | 3/1977 | Simmons | 52/8 |
| 4,077,334 | 3/1978 | Svirklys | 52/669 |
| 4,126,354 | 11/1978 | DeLong | 52/8 |

FOREIGN PATENT DOCUMENTS

| | | | |
|---|---|---|---|
| 104536 | 8/1966 | Denmark | 52/716 |

*Primary Examiner*—Price C. Faw, Jr.
*Assistant Examiner*—Henry E. Raduazo
*Attorney, Agent, or Firm*—Arthur G. Yeager

[57] ABSTRACT

A bleacher structure for spectators comprising a system of interconnected upright posts, cross beams, and diagonal stiffening members with channel beam seats and channel beam footrests locked into the structure by means of hook members on the channel beams cooperating with slots in the upright posts and the cross beams.

10 Claims, 5 Drawing Figures

FIG. 4
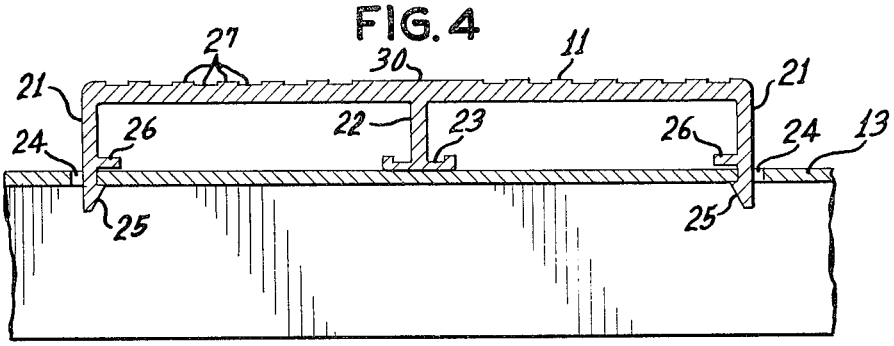
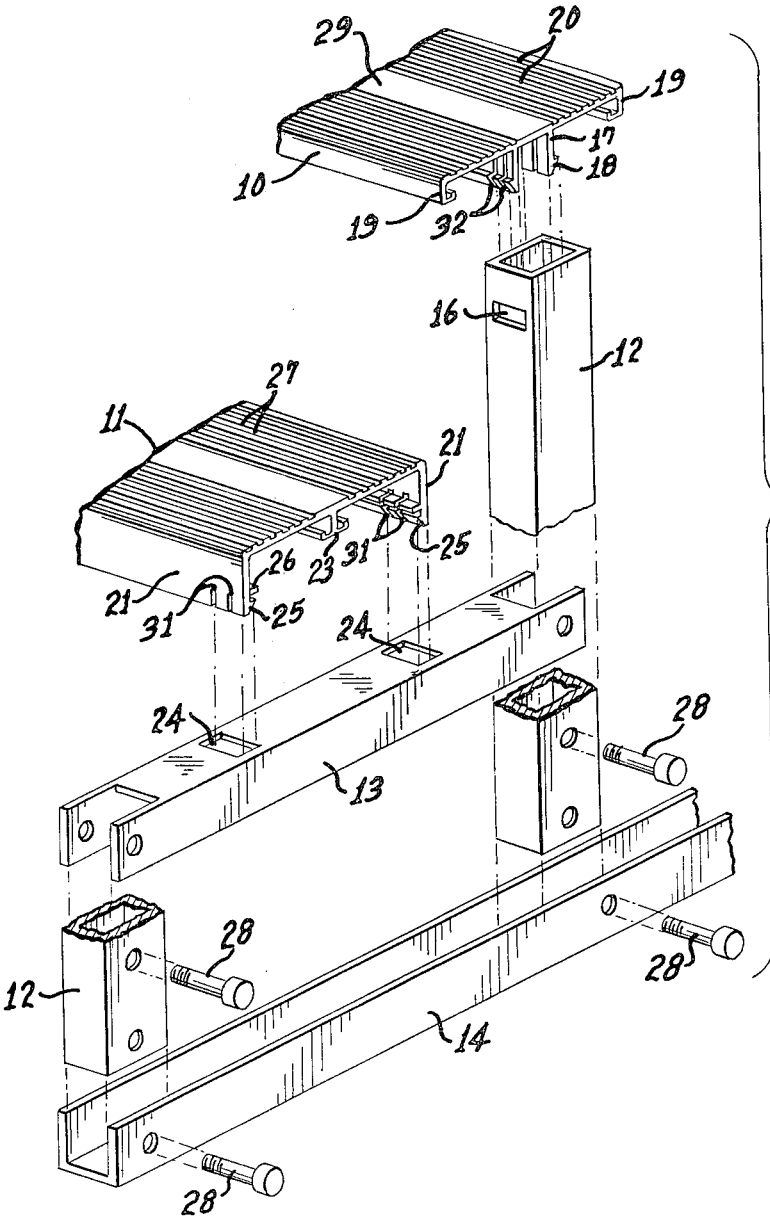
FIG. 5

BLEACHER STRUCTURE

BACKGROUND OF THE INVENTION

Bleacher structures have been used for many years to hold spectators at sporting events, meetings, etc. In the case of bleachers that can be readily assembled and disassembled there has always been a problem of handling the weight of the components of the structure and the expense of assembling and disassembling the structure. Because of the necessity of making the structure strong enough and rigid enough to hold spectators it has normally been found desirable to use heavy components and to securely bolt such components into place. In more recent times it has been found that extruded metal shapes that are light weight and yet are strong can be employed for these structures. In U.S. Pat. No. 4,011,695 there is a structure employing channel beams, circular posts, and extruded channel beam shapes as the seats and footrests of the structure. The seats and the footrests are identical extruded shapes but are assembled in different ways when used as a footrest than when used as a seat. The footrests are snapped into place by cooperation of the prongs on the underneath portion of the footrest and slots on the cross beams which support the posts. The seats are bolted to the top of the post. While this structure has met some of the problems of the prior art it requires a considerable amount of labor to install the many bolts and nuts needed to fasten the seats to the top of the posts. The footrest member is not believed to be as stable as it might be with a better design.

It is an object of this invention to provide an improved design of bleacher structure which is capable of being assembled or disassembled with a minimum of time and expense. It is another object of this invention to provide an improved design of bleacher structure which does not require the use of bolts and nuts to attach the footrests or the seat members to the structure. Other objects will be apparent from the more detailed description of this invention which follows:

BRIEF SUMMARY OF THE INVENTION

This invention provides a bleacher structure having channel beam seat members and channel beam foot rest members supported by an interconnected system of upright posts, cross beams, and diagonal stiffening members, said seat members having legs with hook projections to cooperate with notches in the upper portions of said post to connect said seat members to said post, and said footrest members having legs with hook projections to cooperate with slots in said cross beams to connect said footrest members to said cross beams. In a specific embodiment of this invention the upright posts are rectangular tubular columns. In another embodiment of this invention the upright posts, cross beams, and channel beams are extruded metal shapes.

This invention also provides an E-shaped channel beam, having a base web portion, a rib perpendicular to the base web portion at each end thereof, and a central rib perpendicular to the base web portion at the center thereof, each end rib terminating in a hook member and having an inwardly directed flange spaced apart from the hook member, the center rib terminating in a foot member, the outer surfaces of the foot member and of both of said flanges being substantially coplanar.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

FIG. 4 is a cross sectional view of the footrest member in position on a cross beam.

FIG. 5 is an exploded perspective view of several components of the bleacher structure of this invention showing how they are assembled.

DETAILED DESCRIPTION OF THE INVENTION

Figure 1:
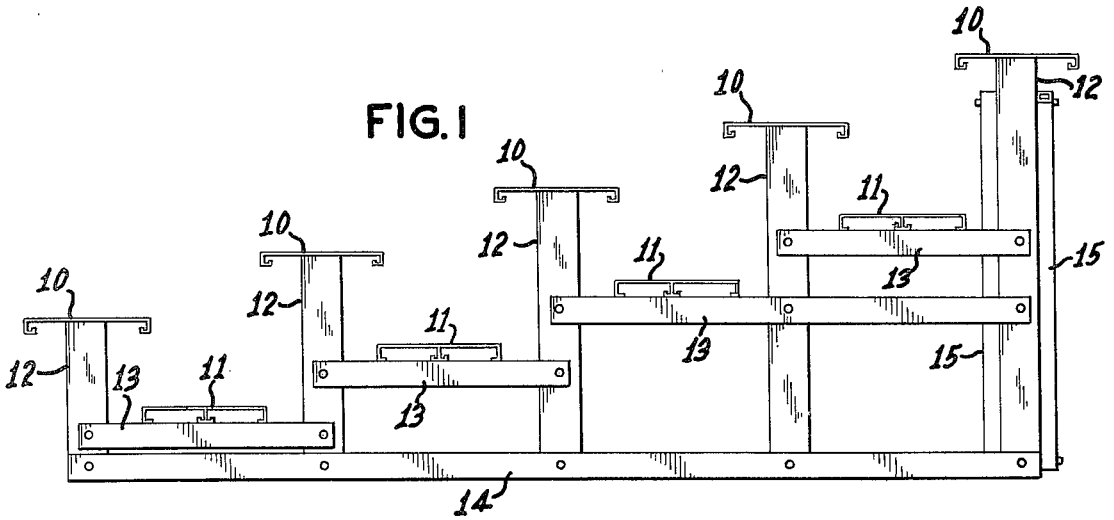
FIG. 1 is an end view in elevation of the bleacher structure of this invention.
Figure 2:
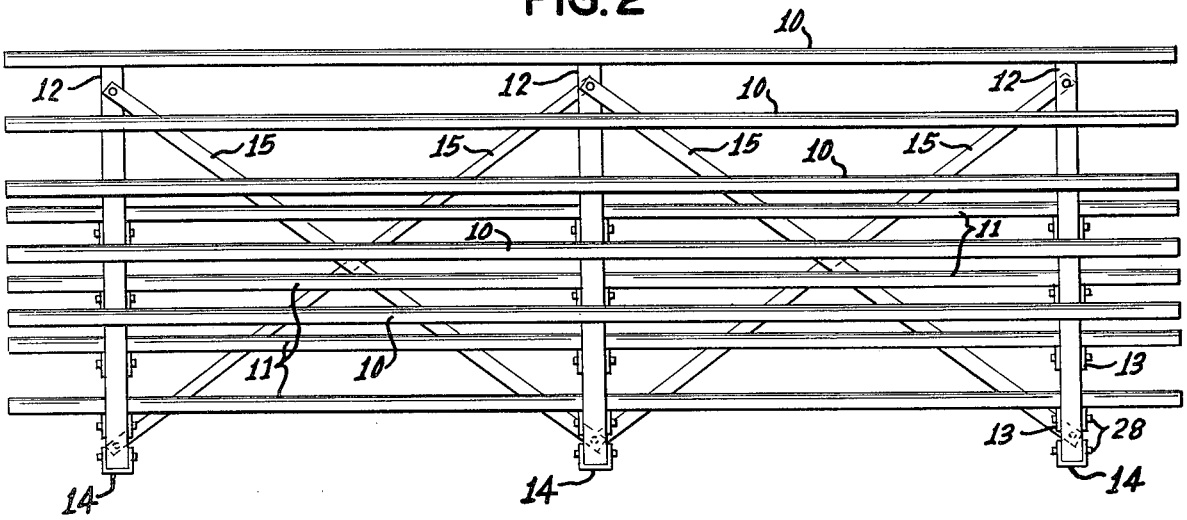
FIG. 2 is a front view in elevation of the bleacher structure of this invention.

With specific reference to FIGS. 1 and 2 the general structure of the bleacher of this invention can be understood. Each bleacher unit is generally made of three upright supports across which are laid the seat members and the footrest members. Diagonal stiffening members are normally placed across the back of the structure in order to provide an increased rigidity. While there is no criticality about the particular design as shown in these drawings the supporting structural units are usually made up of a series of upright posts 12 resting on a base support member 14, and a number of cross beams 13. The components in these units are bolted together and the structure is usually stored as a unit that is not broken down each time the bleacher is disassembled. The supporting structural units are normally held in position by diagonal tie bars 14 which provide sufficient rigidity to hold the upright units in place. Seat members 10 are then snapped into place across the top of upright posts 12 and footrest members 11 are snapped into place across appropriate cross beams 13.

Figure 3:
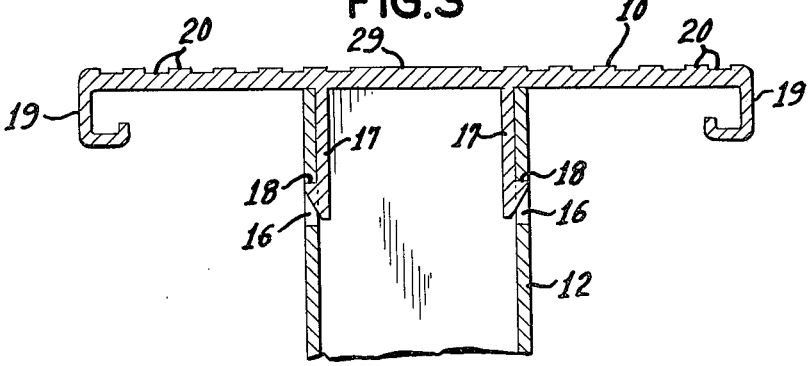
FIG. 3 is a cross sectional view of the seat member positioned on top of the upright posts.

With the specific reference to FIG. 3 the structure of seat member 10 and its method of attachment to upright post 12 can best be understood. The seat member is a channel beam having a base web portion 29 and two end ribs 19 which are curled inwardly to provide freedom from any sharp edges and to add to the stiffness of the beam. Centrally located on the same side of the beam are two downwardly projecting fingers 17 which have outwardly facing hook members 18 at the end of the fingers. Hook members 18 cooperate with suitable openings 16 in post 12. It may be seen that in assembling the seat to the post all that is necessary is to push downwardly on the seat causing fingers 17 to bend backward slightly until the hook member 18 has reached opening 16 permitting hook member 18 to spring back to its original position and to lock itself into opening 16. It may be appreciated that the exact design of hook member 18 and opening 16 can be varied somewhat so long as there is an opportunity to push the seat into place and to permit the hook to snap into a locking position and leave the seat supported on the top of post 12. The upper surface of web portion 29 is preferably grooved or fluted as at 20 to provide a type of tread that provides a more secure seating surface and a safer surface for the spectators to walk on.

In FIG. 4 there are shown the details of the footrest channel. This member has a cross section which is generally E-shaped, having a base web portion 30, two outside legs 21, and one central support rib 22. The two outside legs 21 are fitted with a hook portion 25 at the end of each leg similar to those just described with respect to FIG. 3. Preferably the hook members are inwardly facing. Each of hook members 25 cooperates with an opening 24 in cross beam 13 which supports the footrest channel. Hook members 25 and openings 14 are so positioned that the footrest channel can be assembled to cross beam 13 merely by pushing hook members 25 into openings 24 causing legs 21 to bend backwards slightly until hook member 25 has been inserted far enough into opening 24 to permit leg 21 to spring back to its original position and to lock the shoulder of hook member 25 onto the edge of opening 24.

In order to provide greater stability for the spectator standing on the footrest channel of this drawing flanges 26 are included to prevent the channel from tipping if the spectator should stand on the forward or rearward portion of the channel. In the central portion of web portion 30 is support rib 22 terminating in a foot 23, the supporting surfaces of flanges 26 and of foot member 23 being substantially coplanar. This channel beam, like that of the seat described with respect to FIG. 3, has grooves or flutes 27 on its upper surface to provide a safer footing for spectators standing or walking on this beam.

In FIG. 5 there is an exploded perspective view of the various components of the bleacher unit of this invention. Base support 14 is generally a channel member which provides a large support area to prevent seat columns 12 from penetrating into the ground. Seat columns 12 are usually bolted to base support 14 and appropriate cross beams 13 are bolted to seat columns 12 by means of bolts 28. Cross beams 13 are pierced with appropriately slots 24 into which the hook fastening members of footrest 11 can be inserted. It will be seen that in order to make the footrest channel beam cooperate with slots 24, it is merely necessary to cut an appropriate pair of notches 31 which will permit the central portion between those notches to slide into opening 24 and to snap into place. At the top of each column 12 is a pair of slots 16 which are so positioned and so sized as to receive the hook fastening member of seat 10. Similarly to that described above fingers 17 must be cut with an appropriate pair of notches 32 to permit the portion of fingers 17 between those notches to slide into the center of column 12 and to snap into place in slots 16. It will be appreciated that the assembly and disassembly of the bleacher unit of this invention can be done quickly and easily and thus save considerable time and expense.

While the invention has been described with respect to certain specific embodiments, it will be appreciated that many modifications and changes may be made by those skilled in the art without departing from the spirit of the invention. It is intended, therefore, by the appended claims to cover such modifications and changes as fall within the true spirit and scope of the invention.

What is claimed as new and what is desired to secure by Letters Patent of the United States is:

1. An integral and extruded E-shaped channel beam for attachment to a pair of spaced supporting cross beams having spaced slots therein comprising a base web portion, a rib perpendicular to said web portion at each end thereof and a central rib perpendicular to said base web portion, each said end rib terminating in a hook member and having an inwardly directed flange spaced apart from said central rib, said central rib terminating in a foot member extending toward each of said flanges, the outer bearing surfaces of said foot member and of each of said flanges being substantially coplanar, when said beam is mounted to the supporting cross beams, each of said outer bearing surfaces of said foot member and each said flange contacts the upper bearing surface of the respective supporting cross beams and said hook members lockingly engage within the spaced slots of the respective cross beams to securely fix said channel beam to the cross beams.

2. A bleacher structure having channel beam seat members and channel beam footrest members supported by an interconnected system of upright posts being rectangular in cross-section, cross beams, and diagonal stiffening members, said seat members having flat legs with hook projections to be inserted inside the upper open end of said posts to lie adjacent flat inner and opposed surfaces of said rectangular posts, and by spring action to lock said projections into slots in said posts so as to connect said seat members securely to said posts, the top edge of each of said posts being contacted by the lower surface of respective said seat members to support said members, and said footrest members adjacent the outside edges thereof having legs extending downwardly with hook projections to be inserted into slots in said cross beams and by spring action to lock into said slots so as to connect said footrest members securely to said cross beams.

3. The structure of claim 2 wherein the upright posts, the cross beams, and the channel beams are metal.

4. The structure of claim 3 wherein the upright posts, the cross beams, and the channel beams are extruded metal shapes.

5. The structure of claim 2 wherein said footrest members include flanges resting on said cross beams to enhance the stability of said structure.

6. A bleacher structure comprising rows of upright tubular posts interconnected with cross beams and diagonal stiffening members, with channel beam seat members extending between and resting on the top ends of said posts and with channel beam footrests extending between and resting on said cross beams, said channel beam seat members having a plurality of downwardly projecting pairs of adjacent fingers each with oppositely outwardly facing hook members that cooperate with openings on opposite sides of said posts by being bent backwards when inserted into the top of one of said posts and springing forward to lock said hook members into said openings; said channel beam footrest members having on each edge thereof a plurality of downwardly projecting fingers with inwardly facing hook members that cooperate with openings in said cross beams by being bent backwards when inserted into said openings and springing forward to lock said hook member to said cross beam.

7. The bleacher of claim 6 wherein said foot rest member also includes a central supporting web, the bottom of which rests on each said cross beam.

8. The bleacher of claim 6 wherein said footrest member includes an inwardly directed supporting flange on each of said fingers positioned adjacent said hook member so as to be capable of engaging the upper surface of said cross beam when said hook member is locked to said cross beam.

9. The bleacher of claim 6 wherein said posts are rectangular tubular columns.

10. The structure of claim 6 wherein said seat member is an extruded channel with a pair of spaced depending walls generally medially thereof, a plurality of spaced pairs of notches vertically cut in said walls to form said plurality of downwardly projecting pairs of fingers on each said depending walls, said posts lying in said notches and the upper ends of said posts engaging the lower surface of said seat members.

* * * * *